United States Patent [19]

Brown et al.

[11] Patent Number: 4,614,052

[45] Date of Patent: Sep. 30, 1986

[54] FIREARM MAGAZINE AND MAGAZINE LOADER

[76] Inventors: Robert C. Brown, 2138 E. Petunia; William Gomez, 714 S. Pennsylvania Ave., both of Glendora, Calif. 91740

[21] Appl. No.: 750,100

[22] Filed: Jun. 28, 1985

[51] Int. Cl.[4] ..... F42B 39/06; F41C 25/02

[52] U.S. Cl. ..... 42/87; 42/50

[58] Field of Search ..... 42/50, 87, 88

[56] References Cited

U.S. PATENT DOCUMENTS

| | | | |
|---|---|---|---|
| 1,158,981 | 11/1915 | Carl | 42/50 |
| 1,797,951 | 3/1931 | Gaidos | 42/50 |
| 2,014,177 | 9/1935 | Herlach et al. | 42/50 |
| 2,237,712 | 4/1941 | Mullins | 42/88 |
| 2,403,012 | 7/1946 | McPheters | 42/87 |
| 2,462,836 | 3/1949 | Barker et al. | 42/87 |
| 2,659,173 | 11/1953 | Capito | 42/87 |
| 2,773,325 | 12/1956 | Hill | 42/50 |
| 2,882,635 | 4/1959 | Hill | 42/50 |
| 2,981,024 | 4/1961 | Skoff | 42/87 |
| 4,430,821 | 2/1984 | Vincent | 42/50 |

FOREIGN PATENT DOCUMENTS

| | | | |
|---|---|---|---|
| 62571 | 5/1924 | Finland | 42/50 |

*Primary Examiner*—Charles T. Jordan

*Attorney, Agent, or Firm*—Benoit Law Corporation

[57] ABSTRACT

Firearm magazines and magazine loaders for firearm cartridges include a channel-shaped container having a bottom wall of a width of more than one and less than two cartridge diameters, and side walls corresponding in height to a cartridge shell, and having an elongate open top extending between the side walls opposite and parallel to the closed bottom wall for receiving the cartridges so that each circular bottom of each cartridge is located at the closed bottom wall, so that the shell of each cartridge extends parallel to and is retained between the side walls, and so that the bullets of the cartridges are located at the open top. A lid for closure of the open top above the bullet is provided for retention of the cartridges in the channel-shaped container preparatory to a transfer of such retained cartridges through an opening out of the channel-shaped container with the aid of an actuated or biased cartridge seater.

36 Claims, 4 Drawing Figures

FIREARM MAGAZINE AND MAGAZINE LOADER

BACKGROUND OF THE INVENTION

1. Field of the Invention

The subject invention relates to firearms, to cartridge magazines and to magazine loaders, and to methods and apparatus for storing cartridges or charging magazines.

2. Information Disclosure Statement

The following disclosure statement is made pursuant to the duty of disclosure imposed by law and formulated in 36 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

U.S. Pat. No. 2,237,712, by F. G. Mullins, issued Apr. 8, 1941, discloses a cartridge holder in which cartridges are loaded in alternating different directions and have to be individually removed by manual actuation of an alternating gate serving two chambers.

U.S. Pat. No. 2,403,012, by L. L. McPheters, issued July 2, 1946, discloses a magazine loader in which cartridges are disposed sideways in a channel-shaped member so that the bullets faced one side wall and the cartridge bottoms the opposite side wall of the channel member. That arrangement permitted only a single unstaggered layer of cartridges to be deposited in the channel member, so that the same either had only a limited capacity or had to be relatively long in any case. Also, that magazine loader required a lid which was located on top of the sides of the cartridges, so that an elongate slot for the handle of a cartridge seater had to be provided in that removable lid. That kind of construction also required a track for the cartridge seater, running inside the channel at a distance from the bottom thereof, and thereby consuming space that, with a radically different construction, could have been employed for a staggering of deposited cartridges.

The kind of construction there proposed also required the lid to be hinged laterally to one of the side walls of the channel-shaped container.

U.S. Pat. No. 2,462,836, by R. S. Barker et al, issued Mar. 1, 1949, discloses a cartridge clip loader of a design less than adequate for field use, particularly in terms of lack of inherent sturdiness.

U.S. Pat. No. 2,659,173, by G. D. Capito, issued Nov. 17, 1953, discloses a device for loading the magazines of automatic guns which not only required a two-hand operation for pushing gun shells out of the loader, but in terms of design approach was only suitable for the Oerlikon and other heavy field and navy guns.

U.S. Pat. No. 2,773,325, by J. L. Hill, issued Dec. 11, 1956, discloses a magazine and cartridge container assembly in which cartridges are pre-packaged in a cardboard or similar container.

U.S. Pat. No. 2,981,024, by E. Skoff, issued Apr. 25, 1961, discloses a cartridge loader for a tubular magazine, in which cartridges, like in the above mentioned Capito device, first had to be inserted through the discharge opening of the loader. Of course, that would not have been particularly convenient in practice and, in effect, would have resulted in as much work, as if the cartridges were directly loaded into the magazine of the particular gun or firearm.

In consequence, up to the present, firearm magazines continued to be loaded the old way, in which cartridges have to be pushed individually through the magazine discharge opening against the bias of an increasingly stiff spring. Especially for automatic firearms, this is a laborious and time-consuming operation, particularly with cold fingers out in the field. The user of the firearm thus is rendered periodically helpless for the duration of the time required to load the magazine of the automatic firearm, inasmuch as he or she cannot practically carry an unlimited number of loaded magazines into the field. This thus can cause a dangerous situation, especially under enemy fire in a military situation or in the presence of firing criminals in law enforcement. Even in the area of hunting, the periods of time for reloading a rifle should be kept at a minimum in the presence of wild animals.

SUMMARY OF THE INVENTION

It is a general object of this invention to overcome the disadvantages and meet the needs expressed or implicit in the above Information Disclosure Statement or in other parts hereof.

It is a related object of this invention to provide improved methods and apparatus for storing cartridges for a firearm.

It is a germane object of this invention to provide improved firearm magazines which can be laterally opened for an insertion of cartridges and which are inserted into the lower cavity of the firearm in lieu of the regular magazine for that firearm.

It is also an object of this invention to provide improved methods and apparatus for charging firearm magazines for cartridges.

Other objects of this invention will become apparent in the further course of this disclosure.

From one aspect thereof, the subject invention resides in a method of charging a magazine for a firearm with cartridges each comprising a hollow-cylindrical shell carrying a bullet at a first end thereof and having a circular bottom at an opposite second end thereof, in which method the cartridges are placed in a channel-shaped elongate container having side walls and a closed bottom wall extending longitudinally of the container, and being closed by a lid before the placed cartridges are transferred from the container into the magazine, having an opening through which the placed cartridges are transferred into the magazine, and containing a cartridge seater with projecting handle by way of which the placed cartridges are pushed through the opening into the magazine.

The invention according to this aspect resides, more specifically, in the improvement comprising in combination the steps of making the bottom wall of a width of more than one and less than two diameters of the circular bottom, making each of the side walls correspond in height to a height of the shell from the circular bottom, providing the channel-shaped container with an elongate open top extending between the side walls opposite and parallel to the closed bottom wall and corresponding in width to said bottom wall, providing one of the side wall with an elongate slot for projection of the handle out of the one side wall of the container and movement of the handle and cartridge seater along the container, placing the cartridges through the open top into the container so that the circular bottom of each cartridge is located at the closed bottom wall, so that the shell of each cartridge extends parallel to and is retained between the side walls and so that the bullet of the cartridges are located at the open top, and providing the lid for closure of the open top above the bullets as seen from the circular bottoms of the placed cartridges, preparatory to placement of the container at the opening on the magazine and transfer of the latter placed cartridges with the handle and seater into the magazine through the opening.

From a related aspect thereof, the subject invention resides in a method of storing cartridges for a firearm with each cartridge including a hollow-cylindrical shell carrying a bullet at the first end thereof and having a circular bottom at an opposite end thereof.

The invention according to this aspect resides, more specifically, in the improvement comprising in combination the steps of providing a first channel-shaped member with a width larger than the diameter of the circular bottom, but smaller than twice the diameter, providing a second channel-shaped member to extend along the first channel-shaped member, providing the first and second channel-shaped members with a composite first wall having a first wall portion integral with and extending along the first channel-shaped member and having a second wall portion integral with and extending along the second channel-shaped member, and with a composite second wall having a third wall portion integral with and extending along the first channel-shaped member and having a fourth wall portion integral with and extending along the second channel-shaped member, providing the first wall portion with an elongate slot along at least part thereof, providing the first channel-shaped member with a cartridge seater having a handle extending through said slot, exposing an open top of the first channel-shaped member between the first and second channel-shaped member, receiving each cartridge through the exposed open top at the shell and circular bottom of that cartridge, straddling the bullets of received cartridges with the second and fourth wall portions and closing the open top of the first channel-shaped member with the second channel-shaped member preparatory to transfer of the received cartridges through an outlet of the cartridges, and moving the cartridge seater toward the outlet for transferring the received cartridges through the outlet.

From a related aspect thereof, the subject invention resides in apparatus for storing cartridges for a firearm with each cartridge including a hollow-cylindrical shell carrying a bullet at a first end thereof and having a circular bottom at an opposite second end thereof.

The invention according to this aspect resides, more specifically, in the improvement comprising, in combination, a channel-shaped container having a bottom wall of a width larger than the diameter of the circular bottom, but smaller than twice the diameter and side walls corresponding in height to a height of the shell, and having an elongate open top extending between side walls opposite and parallel to the closed bottom wall and corresponding in width to said bottom wall, for receiving the cartridges into the container so that the circular bottom of each cartridge is located at the closed bottom wall, so that the shell of each cartridge extends parallel to and is retained between the side walls and so that the bullets of the cartridges are located at the open top, a cartridge seater in the channel-shaped container having a projecting handle, one of the side walls having an elongate slot for projection of said handle out of the one side wall of the container and movement of the handle and cartridge seater along the container, and a lid for closure of the open top above the bullets as seen from the circular bottoms of the placed cartridges for retention of cartridges in the channel-shaped container preparatory to a transfer of the retained cartridges through an opening out of the channel-shaped container.

From a related aspect thereof, the subject invention resides in apparatus for storing cartridges for a firearm with each cartridge including a hollow-cylindrical shell carrying a bullet at a first end thereof and having a circular bottom at an opposite second end thereof.

The invention according to this aspect resides, more specifically, in the improvement comprising, in combination, a first channel-shaped member having a width of more than one and less than two diameters of the circular bottom, a second channel-shaped member extending along the first channel-shaped member, a composite first wall for the first and second channel-shaped members having a first wall portion integral with and extending along the first channel-shaped member and having a second wall portion integral with and extending along the second channel-shaped member, a composite second wall having a third wall portion integral with and extending along the first channel-shaped member and having a fourth wall portion integral with and extending along the second channel-shaped member, the first wall portion having an elongate slot along at least part thereof, a cartridge seater in the first channel-shaped member having a handle extending through the slot, an exposable top of the first channel-shaped member between the first and second channel-shaped members for receiving each cartridge at the shell and circular bottom of the cartridge through the top upon exposure of the top, and a joint opening of the first and second channel-shaped members for a transfer of the received cartridges out of the channel-shaped members upon movement of the cartridges seater toward the joint opening.

Other aspects of the invention will become apparent in the further course of this disclosure, and no restriction to any aspect or feature is intended by the subject Summary of the Invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
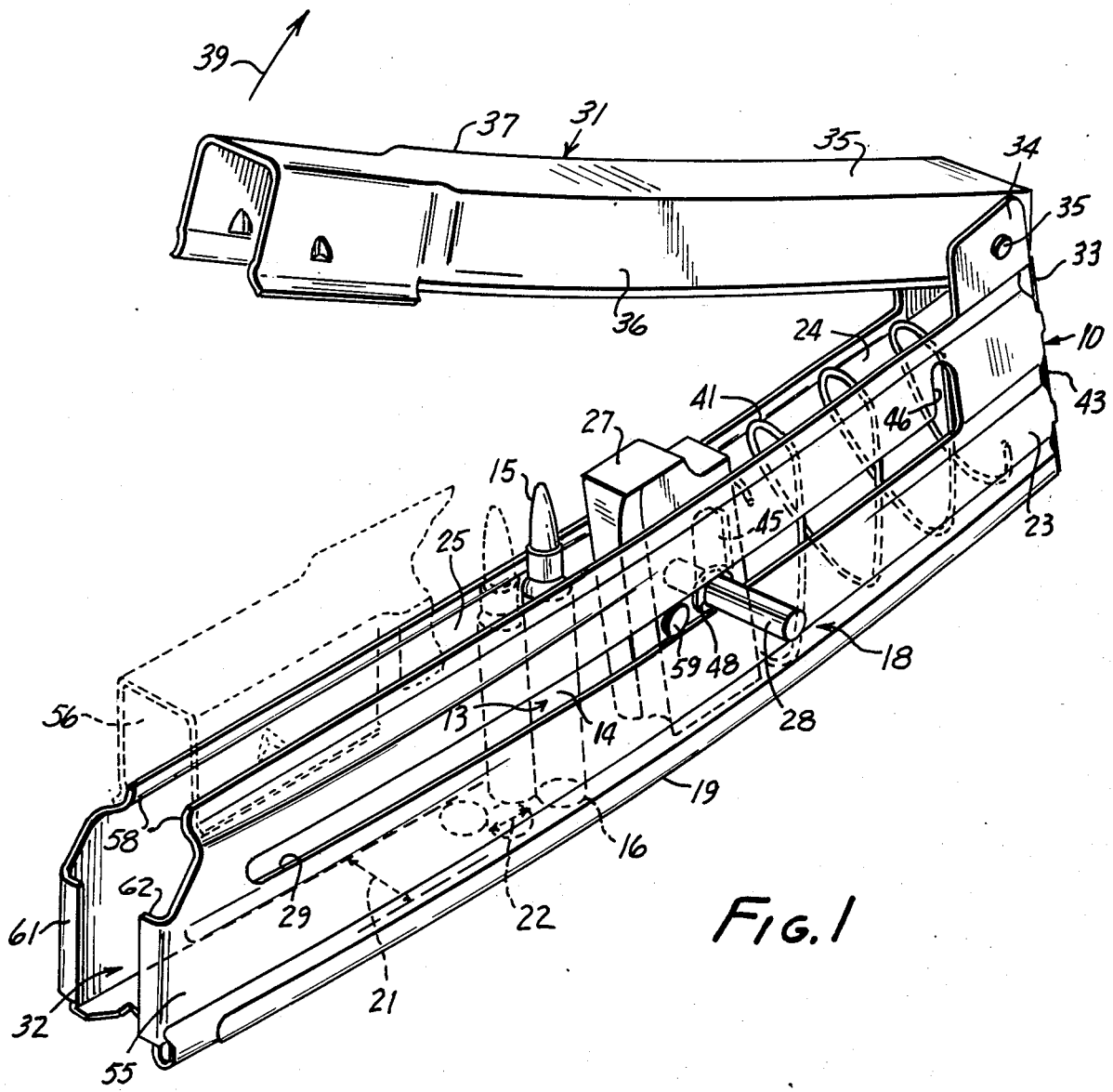
FIG. 1 is a perspective view of a firearm magazine according to a preferred embodiment of the subject invention.
Figure 2:
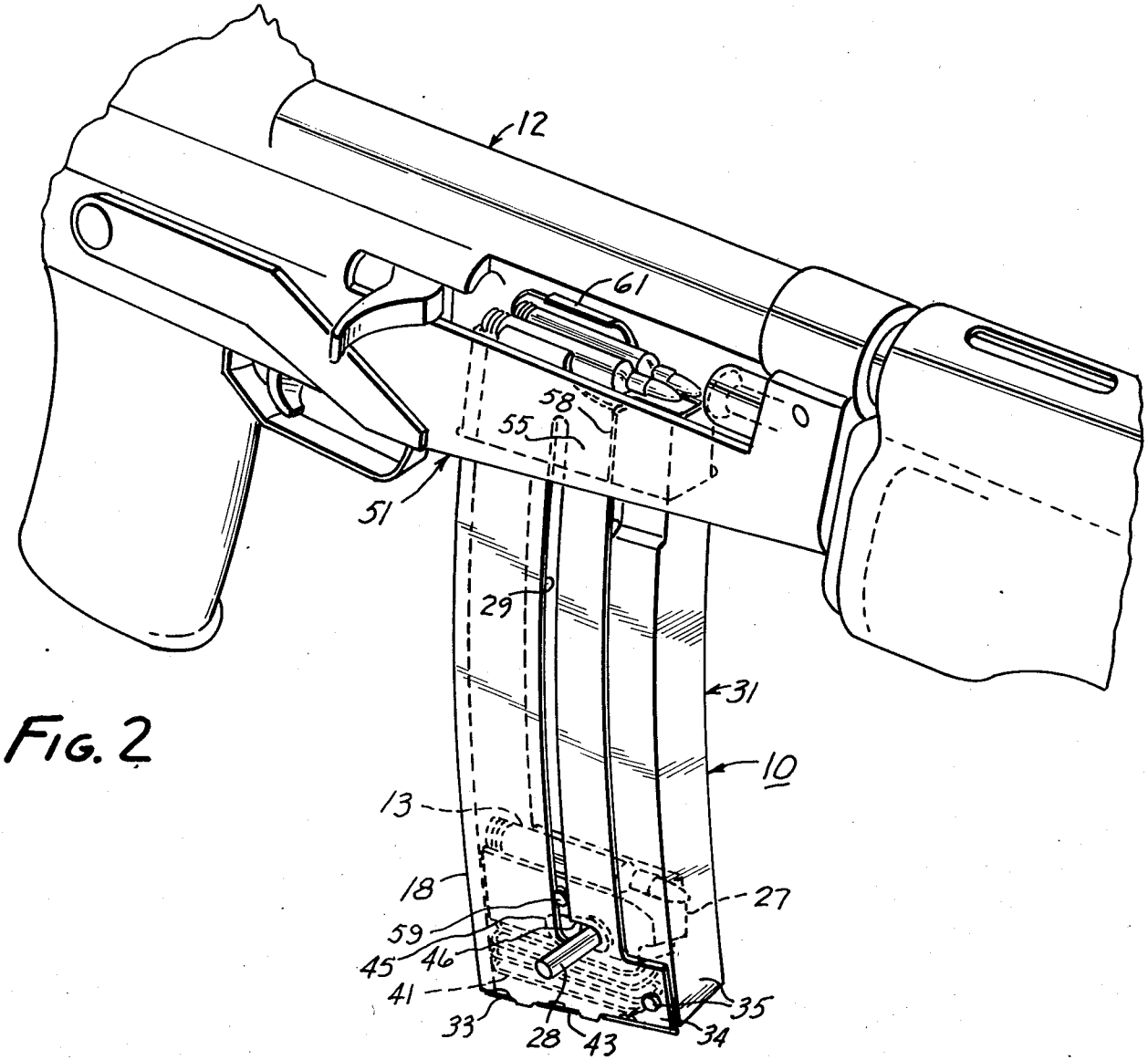
FIG. 2 is a perspective view of part of a firearm equipped with the cartridge magazine of FIG. 1.

FIGS. 1 and 2 show a cartridge magazine according to a preferred embodiment of the subject invention, for use directly on a firearm, part of which is seen at 12 in FIG. 2. The magazine 10 stores cartridges 13 preparatory to their use in the firearm 12. Each cartridge includes a hollow-cylindrical shell 14 carrying a bullet 15 at the first end thereof and having a circular bottom 16 at an opposite second end thereof. In practice, the bottom 16 carries the detonator or percussion cap for firing the powder charge or explosive in the cartridge shell upon being struck by the firing pin of the weapon 12.

The magazine 10 includes a channel-shaped container 18 having a bottom wall 19 of a width 21 larger than the diameter 22 of the circular cartridge bottom 16, but smaller than twice that diameter. In other words, the width 21 of the channel-shaped member 18 is more than one and less than two diameters 22 of the circular bottom 16 of a cartridge 13. The width 21 in this respect is the internal width of the channel 18 or channel bottom 19. That width has to be at least slightly larger than the diameter 22, so that cartridges 13 may be inserted into and can be stored in a single-file manner in the magazine 18. As illustrated in FIG. 1, the channel or bottom width may be larger than one diameter, so that cartridges 13 may be stored in a staggered fashion in the magazine 18. However, the width 21 is less than two diameters 22, so that no gate of the type shown, for instance, by the above mentioned Mullins U.S. Pat. No. 2,237,712 is needed in the magazines, cartridge storing apparatus and magazine chargers of the illustrated preferred embodiments of the subject invention.

The magazine 10 or channel-shaped container 18 of the illustrated preferred embodiment of the invention has side walls 23 and 24 corresponding in height to a height of the cartridge shell 14, more or less, as shown, for example, in FIG. 1.

The channel-shaped container 18 has an elongate open top 25 extending between the side walls 23 and 24 opposite and parallel to the closed bottom wall 19. Like the internal part of the bottom wall 19, the open top 25 is larger than once, but smaller than twice the cartridge bottom diameter 22, for receiving the cartridges 13 into the container so that the circular bottom 16 of each cartridge is located at the closed bottom wall 19, and so that the shell 14 of each cartridge extends parallel to and is retained between the side walls 23 and 24, and further so that bullets 15 of the cartridges are located at the open top 25, protruding therefrom, as seen in FIG. 1. Again, the width of the open top 25 is at least such that cartridges 13 can be inserted in single file, but may be made wide enough for a staggered retention of the cartridges 13 in the magazine 10, as seen in FIG. 1, for instance.

A cartridge seater 27 is located in the channel-shaped container 18 and has a laterally projecting handle 28. One of the side walls, such as the side wall 23, has an elongate slot 29 for projection of the handle 28 out of that one side wall of the container 18 and for movement of that handle 28 and cartridge seater 27 along the cartridge container 18. The cartridge seater 27 alternatively may be termed a cartridge follower, particularly if the cartridge storing apparatus is a magazine, such as in FIGS. 1 and 2 of the drawings.

The magazine 10 also includes a lid 31 for closure of the open top 25 above the bullets 15, as seen from the circular bottoms 16 of the placed cartridges, for retention of such cartridges 13 in the channel-shaped container 18 preparatory to a transfer of the retained cartridges through an opening 32 out of the channel-shaped container 18 or magazine 10.

The lid 31 is hinged on the channel-shaped container at the end 33 of that container 18 opposite the cartridge discharge opening 32. For this purpose, the container 18 may have a pair of projecting lugs, one of which is seen at 34, and a pivot pin 35 extending through the lugs and intervening portion of the lid 31.

The lid 31 according to the illustrated preferred embodiment has a channel-shaped configuration, having a lid top 35 spaced from and extending parallel to the bottom wall 19 when the lid is closed, and having lid side walls 36 and 37, extending from the lid top to the container side walls 23 and 24, respectively, when the lid 31 is located on the channel-shaped container 18 for closure of the open top 25. The lid 31 having the illustrated channel-shaped configuration may be hinged on the channel-shaped container 18 at an end 33 thereof as disclosed above.

The magazine 10 is opened for insertion of cartridges 13 by swinging the lid 31 about the pivot 35 at an end thereof in the direction of arrow 39, until the open top 25 of the container 18 is sufficiently exposed. The cartridge seater or follower 27 is moved towards the end 33 against the bias of a spring 41 located between the cartridge seater or follower 27 and the bottom plate 43 of the magazine 10 at the end 33.

The cartridge seater or follower 27 has an elongate slot 45 extending transversely to the elongate slote 29 in the magazine side wall 23. In particular, the seater or follower slot 45 corresponds to a slot 46 which extends in the side wall 23 from an end of, and transversely to, the elongate side wall slot 29. That second side wall slot 46 serves to receive the handle 28 at the end of the travel of the cartridge seater or follower 27. In practice, this is accomplished by pushing the cartridge seater or follower backwards, away from the opening 32 and toward the end 33, until the handle 28 has reached the end of the elongate slot 29. At that point, the user's hand or finger moves the handle 28 sideways, that is, in the slots 45 and 46, to the position of the handle 28 shown in FIG. 2. The handle 28 has a washer-like lateral projection 48 inside the magazine or container wall 23, to prevent the inner end of the handle from falling out of the slot 29. For this purpose, the projection 48 has a diameter larger than the width of the slot 29, and may be accommodated in the cartridge seater or follower by a slot-like clearance corresponding thereto in width and depth. If desired, the cartridge seater or follower 27 may be provided with an internal spring (not shown) that biases the handle 28 transversely to the slot 29, so that the handle is pushed into and retained in the transverse slot 46 at the end of the travel against a toggle or over-center action.

The magazines according to the subject invention, including the preferred illustrated magazine 10, avoid the disadvantages and drawbacks of prior-art magazines and cartridge loaders, in which the cartridges had to be loaded into the magazine or cartridge loader through the same opening through which they were subsequently discharged out of the magazine into the firearm, or out of the loader into a firearm magazine.

As mentioned above, such front loading of magazines against the bias of a spring similar to the spring 41, is an onerous task, especially under field conditions. The above mentioned Mullins U.S. Pat. No. 2,237,712 attempts to avoid this drawback by providing finger pieces and corresponding offset branches in the finger piece slots for holding the cartridge follower springs compressed in the upper end of the compartments, so that the cartridges may be readily placed in the compartments. However, Mullins still needs a fingeractuated gate for a regular discharge of the cartridges from his holder. The Mullins holder thus manifestly is not suitable for use as a magazine on the firearm itself.

The proposal according to the above mentioned Capito U.S. Pat. No. 2,659,173 attempts to avoid the problem by simply deleting any follower spring. In consequence, Capito needs bilaterally projecting follower handles for pushing his shells out of his loader. Again, this precludes the Capito proposal from being suitable as a magazine on the firearm itself.

The proposal according to the above mentioned Skoff Pat. No. 2,981,024 teaches use of a match stick or other small rod for locking the cartridge follower in its rearward position for the cartridge loading operation. Apart from the drawbacks of such a makeshift approach, Skoff also requires the disadvantageous use of the same opening for loading cartridges into his holder, as well as for discharging cartridges into a tubular magazine of the firearm. In practice, this is a very time-consuming job and, if the cartridge seater is withdrawn and the bias spring compressed, requires considerable skill, since the cartridges tend to topple over in the charger chamber, when fed serially through the single opening.

Clip loaders of the type shown in the above mentioned Barker et al. U.S. Pat. No. 2,462,836 also appear to be restricted to a serial insertion of cartridges into the loader, and also appear to be limited to structures that are not generally suitable for heavy field use.

In principle, the above mentioned McPheters U.S. Pat. No. 2,403,012 appeared to have moved in a direction of an eventual solution of these problems. However, the McPheters approach in practice required the cartridges to be disposed sideways in a channel-shaped member in which the bullets faced one side wall and the cartridge bottoms the opposite side wall of that channel member. As mentioned above, that arrangement permitted a single unstaggered layer of cartridges to be deposited in McPheters' channel member, so that the same either had only a limited capacity or had to be relatively long in any case. Also, the McPheters magazine loader required a lid which was located on top of the sides of the inserted cartridges so that an elongate slot for the handle of the cartridge seater had to be provided in that removable lid. In practice, insertion of cartridges in that kind of loader under field conditions is not all that convenient, since cartridges easily can misplace themselves out of McPheters relatively shallow channel member while the insertion of cartridges into the loader is in progress. Also, some skill is required of the user under these conditions to prevent spilling of the inserted cartridges, when McPheters' laterally hinged lid is closed on top of the shallow channel-shaped container.

In practice, that container was even shallower than its outside height, since the McPheters approach required provision of a spaced track for the cartridge seater inside and at a distance from the bottom of McPheters' channel-shaped container.

In consequence, the McPheters approach never resulted in the provision of a magazine usable on the firearm itself and, even in the magazine loader area, was followed by radically different proposals, such as the clip loader approach of the above mentioned Barker et al U.S. Pat. No. 2,462,836, the front loader and discharge proposals of the above mentioned Capito U.S. Pat. No. 2,659,173 and Skoff U.S. Pat. No. 2,981,024, and the prepackaged cartridge proposal according to the above mentioned Hill U.S. Pat. No. 2,773,325.

The subject invention not only overcomes such prior-art shortcomings, but even provides cartridge loading and storage systems that can be used in lieu of the regular magazine of the firearm itself.

By way of background, the firearm 12 has a lower receiver or cavity 51 for receiving an upper end 52 of a magazine 53 which is standard for that firearm. According to the currently discussed aspect of the subject invention, at least the channel-shaped container 18 has an end corresponding to the upper end 52 of the standard magazine, for reception in the firearm cavity 51 in lieu of the standard magazine 53.

According to the preferred embodiment of the subject invention seen in FIG. 1, the channel-shaped container 18 and the lid 31 have complementary channel-shaped ends 55 and 56 jointly constituting the kind of top end 52 shown for the standard magazine 53, for reception of the channel-shaped ends 55 and 56 jointly in the lower receiver cavity 51 of the firearm 12 in lieu of the standard magazine 53, after the cartridges 13 have been inserted in the channel-shaped container 18 and its lid 31 has been closed in mating relationship at interfitting portions 58 of the new magazine ends 55 and 56.

Preparatory to the use of the firearms, the handle 28 is moved in the slots 45 and 46 to the longitudinal slot 29. If a spring bias was employed to urge the handle 28 into the slot 46, then the cartridge seater or follower needs a push-pull or toggle-like arrangement for releasing the handle 28 back into the longitudinal slot 29, when that handle is moved downwardly in slots 45 and 46, as seen in FIG. 1. On the other hand, if no spring bias is employed in the follower 27, then the handle 29 is simply returned by hand into the end of the longitudinal slot 29 below the transverse slot 46, as seen in FIG. 1.

The handle 28 having been released from the transverse slot 46, the bias spring 41 is now able to push the cartridge seater or follower 27 in the direction of the open magazine end 32, where the first cartridge is temporarily retained by inturned lugs 61 and 62. The regular mechanism of the firearm (not shown) is now able to push the cartridges 13 seriatim from the magazine 10 into the firing chamber of the weapon, as if the new magazine 10 were the standard magazine for that firearm As the bullets 15 of successive cartridges 13 are fired out of the weapon, the bias spring 41 and follower 27 present one cartridge after another at the magazine end 32 for lateral ejection into the firing chamber in a direction substantially parallel to the lugs 61 and 62.

A partially or completely empty magazine 10 can easily be reloaded by removing the magazine from the firearm, opening the lid 31 about the hinge 35 before or after a return of the cartridge follower 27 and handle 28 to the rear of the longitudinal slot 29, and lateral movement of the handle 28 in the then registering slots 45 and 46. The magazine 10 may now be completely reloaded by insertion of fresh cartridges into the lower channel-shape container 18. Upon closure of the channel-shaped member 31 and mutual engagement of the end portions at 58, the top end of the magazine 10 at joint end portions 55 and 56 may again be inserted into the lower receiver cavity 51 of the firearm 12, before or after release of the cartridge follower handle 28 from the transverse slot 46.

This convenient process may be repeated as often as desired. Also, while one of the magazines 10 is installed in the firearm 12, other like magazines 10 may conveniently be recharged with cartridges 13 through the open top 25 laterally of the discharge opening 32 for fast firing action.

At least one of the side walls 23 and 24 serves to guide the magazine seater 27 during movement of the handle 28 and cartridge seater 27 along the container 18. In practice, the other of these side walls may also serve as a guide for the cartridge seater 27 during movement of the handle 28 and cartridge seater 27 along the container 18, either in a direction away from the front opening 32, or in a direction toward that front opening, or in both of those directions. This in favorable contrast to the approach of the above mentioned McPheters U.S. Pat. No. 2,403,012, which requires a space-consuming separate track for the cartridge seater.

As shown in FIGS. 1 and 2, the cartridge seater 27 may be provided with a pin 59 projecting into the longitudinal cavity 29 as an anti-rotation device, preventing substantial rotation of the cartridge seater 27 about the handle 28.

Figure 3:
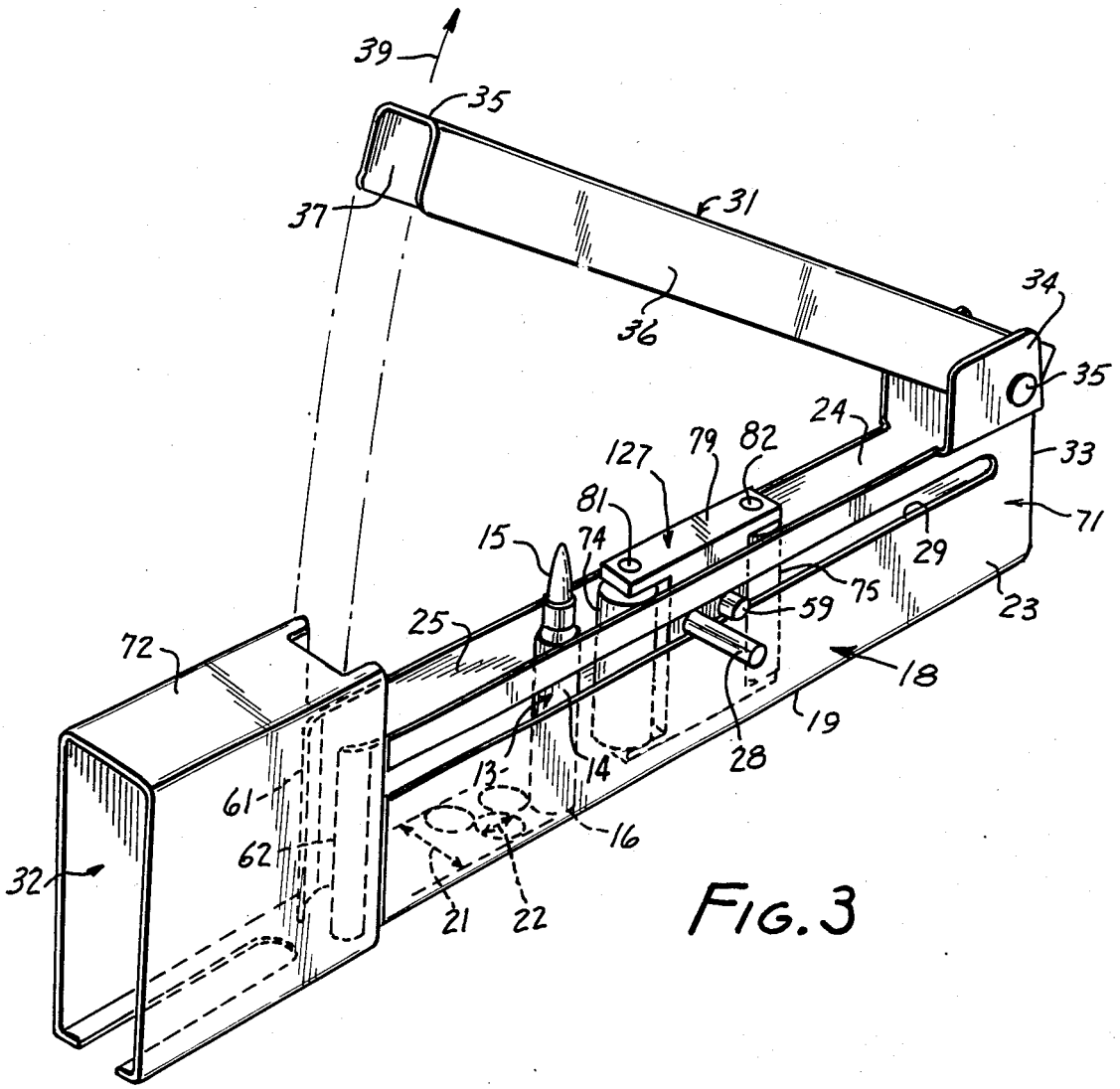
FIG. 3 is a perspective view of a cartridge loader according to another embodiment of the subject invention.
Figure 4:
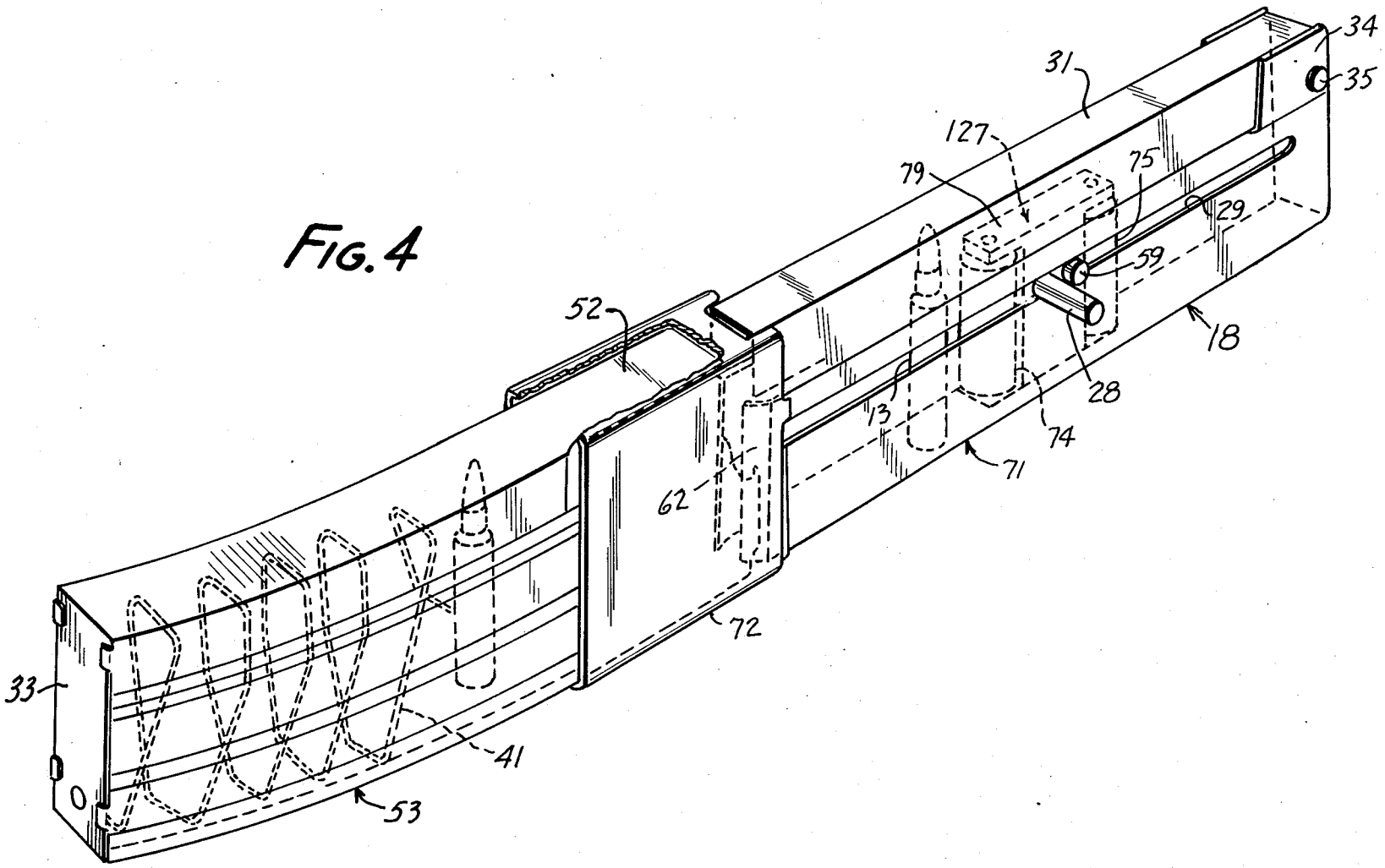
FIG. 4 is a perspective view of a firearm magazine and the cartridge loader of FIG. 3 inserted thereon for loading the magazine.

FIGS. 3 and 4 show a cartridge loader 71 which is related in concept and implementation to the magazine 10 of FIGS. 1 and 2. However, the magazine loader 71 has a retainer 72 encompassing the cartridge discharge opening 32 for retaining the channel-shaped container 18 on a standard magazine 53 during transfer of placed cartridges 13 into the magazine of the firearm 12. In other words, the apparatus 71 shown in FIGS. 3 and 4 serves to load a standard magazine of a firearm with cartridges, rather than being the firearm magazine itself, as in the preferred embodiment of FIGS. 1 and 2.

However, in other respects, the magazine charger 71 essentially may be of the same construction as the new magazine according to FIGS. 1 and 2. The same cartridge seater or follower 27 may be used in the embodiments of FIGS. 1 to 4. Even a cartridge bias spring of the type shown at 41 in FIGS. 1 and 2 with an arresting system employing a transverse slot 46, may be employed in the cartridge loader 71, though not shown in FIGS. 3 and 4 and though not typically necessary in the case of a cartridge loader. FIGS. 3 and 4 show a cartridge seater or follower 127 which has rollers 74 and 75 rollable along an internal surface of at least one of the side walls 23 and 24 during transfer of the received cartridges 13 through the discharge opening 32 or, for that matter, preparatory to insertion of cartridges through the top opening 25 of the opened channel-shaped container 18, transversely to the cartridge discharge opening 32.

For this purpose, the cartridge seater 127 has a frame 79 carrying the laterally projecting handle 28 and anti-rotation pin 59 slidable in the longitudinal loader slot 29. Pins 81 and 82 extend through spaced portions of the frame 79 for rotatably mounting the rollers 74 and 75.

The rollers 74 and 75 reduce any friction between the cartridge seater or follower and the adjacent channel side walls 23 and 24, and facilitate movement of the cartridge seater or follower 127 in the channel-shaped container 18. If desired, one or more of the rollers 74 and 75 may also be employed on the cartridge follower 27 of the magazine 10.

The magazine loader 71 also has substantial advantages over the magazine loader of the above mentioned McPheters U.S. Pat. No. 2,403,012. For instance, by making the bottom wall 19 of a width of more than one and less than two diameters of the circular bottom, the invention provides the potential of a storage of the cartridges in a staggered condition, even though a single-file storage is not excluded thereby. Also, by making each of the side walls 23 and 24 correspond in height to a height of the shell 14 from the circular bottom 16, the subject invention improves insertion and retention of the cartridges 13 into the channel-shaped container 18, already prior to a closure of the lid 31. The same applies essentially to the provision of the channel-shaped container with an elongate open top 25 extending between the side walls opposite and parallel to the closed bottom wall and being in width larger than once, but smaller than twice the diameter of the circular bottom.

Also according to the subject invention, the elongate slot 29 may be provided in one of the side walls 23 or 24 for projection of the handle 28 out of that one side wall of the container 18 and movement of such handle and cartridge seater 27 or 127 along the container 18.

The cartridges 13 may thus be placed through the open top into the container 18 so that the circular bottom of each cartridge is located at the closed bottom wall 19, and so that the shell 14 of each cartridge extends parallel to and is retained between the side walls 23 and 24, and further so that the bullets 15 of the cartridges are located at the open top 25.

As before, a lid 31 is provided for closure of the open top 25 above the bullets 15, as seen from the circular bottom of the placed cartridges, preparatory to placement of the container 18 at the opening 32 on the magazine 53 and transfer of the latter placed cartridges 13 with the handle 28 and seater 27 or 127 into the magazine through the opening 32 and lugs 61 and 62 which, as shown in FIGS. 3 and 4, are slanted in the loader 17, rather than being inturned in the manner shown in FIGS. 1 and 2 for the magazine 10. It will be noted that this aspect of the embodiment of FIGS. 3 and 4 is common with corresponding aspects of the embodiment of FIGS. 1 and 2.

The common features of the new magazine 10 of FIGS. 1 and 2 and the magazine loader 71 of FIGS. 3 and 4 may also be expressed in terms of first and second channel-shaped members. In particular, the magazine 10 and magazine loader 71 each have a first channel-shaped member 18 provided with a width larger than the diameter of the circular bottom 16, but smaller than twice that diameter, and a second channel-shaped member 31 extending along the first channel-shaped member 18.

The first and second channel-shaped members 18 and 31 are provided with a composite first wall having a first wall portion 23 integral with and extending along the first channel-shaped member and having a second wall portion 36 integral with and extending along the second channel-shaped member 31, and with a composite second wall having a third wall portion 24 integral with and extending along the first channel-shaped member 18 and having a fourth wall portion 37 integral with and extending along the second channel-shaped member 31. The first wall portion 23 is provided with an elongate slot 29 along at least part thereof.

The first channel-shaped member 18 is provided with a cartridge seater or follower 27 or 127 having a handle 28 extending through the slot 29. An open top 25 of the first channel-shaped member is exposed between the first and second channel-shaped members 18 and 31, and each cartridge 13 is received through that exposed open top 25 at the shell 14 and circular bottom 16 of that cartridge.

In other words, the magazine 10 or magazine loader 71 has an exposable top 25 of the first channel-shaped member between the first and second channel-shaped members 18 and 31, for receiving each cartridge 13 at the shell 14 and circular bottom 16 of that cartridge through the top 25 upon exposure thereof. As shown in FIGS. 1 and 3, the magazine 10 and the magazine loader 71 have joint opening 32 of the first and second channel-shaped members 18 and 31, for a transfer of the received cartridges out of the channel-shaped members upon movement of the cartridge seater 27 or 127 toward that joint opening. The open top 25 is located laterally of the opening 32 and vice versa.

The bullets 15 of the received cartridges 13 are straddled with the second and fourth wall portions 36 and 37 and the open top 25 of the first channel-shaped member 18 is closed with the second channel-shaped member 31 preparatory to transfer of the received cartridges through the outlet 32 for those cartridges. The cartridge seater 27 or 127 is moved towards that outlet 32 for transferring the received cartridges through that outlet into the firing chamber of the weapon, in the case of the magazine 10, or into a magazine for the firearm in the case of the magazine loader 71.

When the lid provided by the second channel-shaped member 31 is closed, then the first and third wall portions 23 and 36 may essentially be flush with each other, while the second and fourth wall portions 24 and 37 also may essentially be flush with each other.

The second channel-shaped member 31 is hinged on the first channel-shaped member 18 opposite the cartridge outlet 32.

In the case of the magazine 10 illustrated in FIGS. 1 and 2, at least one of the channel-shaped members 18 and 31 has an end 55 for reception in the lower receiver cavity 51 of the firearm 12 in lieu of the end 52 of a standard magazine 53. According to the illustrated preferred embodiment, the first and second channel-shaped members 18 and 31 have complementary channel-shaped ends 55 and 56 jointly constituting a top end of the magazine 10 for reception of these channel-shaped ends jointly in the receiver cavity 51 of the firearm in lieu of a standard magazine.

In the case of the illustrated magazine loader 71, a retainer 72 encompasses the joint opening 32 for retaining the channel-shaped members 18 and 31 on a magazine 53 preparatory to a transfer of the placed cartridges 13 from the loader 71 into that magazine.

The subject invention meets all of its initially mentioned objects and provides improved firearm magazine cartridge loaders, along with improved systems for supplying cartridges to firearms, either through the intermediary of a novel cartridge magazine loader, or directly with the new magazine according to the preferred aspect of the subject invention.

The present extensive disclosure renders apparent or suggests to those skilled in the art various modifications and variations within the spirit and scope of the subject invention and equivalents thereof.

We claim:

1. In a method of charging a magazine for a firearm with cartridges each comprising a hollow-cylindrical shell carrying a bullet at a first end thereof and having a circular bottom at an opposite second end thereof, in which method the cartridges are placed in a channel-shaped elongate container having side walls and a closed bottom wall extending longitudinally of said container, and being closed by a lid before said placed cartridges are transferred from the container into the magazine, having an opening through which said placed cartridges are transferred into said magazine, and containing a cartridge seater with projecting handle by way of which said placed cartridges are pushed through said opening into the magazine, the improvement comprising in combination the steps of:

making said bottom wall of a width of more than one and less than two diameters of said circular bottom;

making each of said side walls correspond in height to a height of said shell from said circular bottom;

providing said channel-shaped container with an elongate open top extending between said side walls opposite and parallel to said closed bottom wall and corresponding in width to said bottom wall;

providing one of said side walls with an elongate slot for projection of said handle out of said one side wall of the container and movement of said handle and cartridge seater along said container;

placing said cartridges through said open top into said container so that the circular bottom of each cartridge is located at said closed bottom wall, so that the shell of each cartridge extends parallel to and is retained between said side walls and so that the bullets of said cartridges are located at said open top; and providing said lid for closure of said open top above said bullets as seen from the circular bottoms of said placed cartridges, preparatory to placement of said container at said opening on the magazine and transfer of the latter placed cartridges with said handle and seater into the magazine through said opening.

2. A method as claimed in claim 1, including the step of:

hinging said lid on said channel-shaped container at an end of said channel-shaped container opposite said opening.

3. A method as claimed in claim 1, including the step of:

providing said lid with a channel-shaped configuration having a lid top spaced from and extending parallel to said bottom wall and having lid side walls extending from said lid top to said side walls when said lid is located on said channel-shaped container for closure of said open top.

4. A method as claimed in claim 3, including the step of:

hinging said lid having said channel-shaped configuration on said channel-shaped container at an end of said channel-shaped container opposite said opening.

5. A method as claimed in claim 1, including the step of:

using at least one of said side walls as a guide for said cartridge seater during movement of said handle and cartridge seater along said container; and sliding said cartridge seater along an internal surface of the side wall used as said guiding during transfer of said placed cartridges through said opening into the magazine.

6. A method as claimed in claim 1, including the steps of:

using the other of said side walls as a guide for said cartridge seater during movement of said handle and cartridge seater along said container; and sliding said cartridge seater along an internal surface of said other side wall during transfer of said placed cartridges through said opening into the magazine.

7. A method as claimed in claim 1, including the steps of:

providing said cartridge seater with roller means; and rolling said roller means along an internal surface of at least one of said side walls during transfer of said placed cartridges through said opening into the magazine.

8. A method as claimed in claim 1, including the steps of:

providing said cartridge seater with roller means; and rolling said roller means along an internal surface of said other side wall during transfer of said placed cartridges through said opening into the magazine.

9. A method as claimed in claim 1, including the step of:

providing a retainer encompassing said opening for retaining said channel-shaped container on the magazine during transfer of said placed cartridges into the magazine.

10. A method as claimed in claim 9, including the step of:

providing said lid with a channel-shaped configuration having a lid top spaced from and extending parallel to said bottom wall and having lid side walls extending from said lid top to said side walls when said lid is located on said channel-shaped container for closure of said open top.

11. In a method of storing cartridges for a firearm with each cartridge including a hollow-cylindrical shell carrying a bullet at a first end thereof and having a circular bottom at an opposite second end thereof, the improvement comprising in combination the steps of:

providing a first channel-shaped member with a width larger than the diameter of said circular bottom, but smaller than twice said diameter;

providing a second channel-shaped member to extend along said first channel-shaped member;

providing said first and second channel-shaped members with a composite first wall having a first wall portion integral with and extending along said first channel-shaped member and having a second wall portion integral with and extending along said second channel-shaped member, and with a composite second wall having a third wall portion integral with and extending along said first channel-shaped member and having a fourth wall portion. integral with and extending along said second channel-shaped member;

providing said first wall portion with an elongate slot along at least part thereof;

providing said first channel-shaped member with a cartridge seater having a handle extending through said slot;

exposing an open top of said first channel-shaped member between said first and second channel-shaped members;

receiving each cartridge through said exposed open top at the shell and circular bottom of that cartridge;

straddling the bullets of received cartridges with said second and fourth wall portions and closing said open top of the first channel-shaped member with said second channel-shaped member preparatory to transfer of said received cartridges through an outlet for said cartridges; and moving said cartridge seater toward said outlet for transferring said received cartridges through said outlet.

12. A method as claimed in claim 11, including the steps of:

making said first and third wall portions flush with each other; and making said second and fourth wall portions flush with each other.

13. A method as claimed in claim 12, including the step of:

hinging said second channel-shaped member on said first channel-shaped member opposite said outlet.

14. A method as claimed in claim 11, including the step of:

using at least one of said wall portions as a guide for said cartridge seater during movement of said handle and cartridge seater toward said outlet.

15. A method as claimed in claim 11, including the step of:

encompassing said outlet with a retainer for retaining said channel-shaped members on a magazine for said firearm.

16. A method as claimed in claim 15, including the step of:

using said channel-shaped members and cartridge seater as a loader for loading cartridges into a magazine for said firearm upon movement of said handle and cartridge and cartridge seater along said elongate slot.

17. A method as claimed in claim 11, including the steps of:

forming said channel members as a cartridge magazine for said firearm; and biasing said cartridge seater toward said outlet.

18. A method as claimed in claim 11, wherein:

said firearm has a cavity for receiving an end of a magazine being standard for that firearm;

at least one of said channel-shaped members is provided with a said end for reception in said cavity of the firearm in lieu of said standard magazine; and said cartridge seater is biased toward said end provided in at least one of said channel-shaped members.

19. A method as claimed in claim 11, wherein:

said firearm has a cavity for receiving an end of a magazine being standard for that firearm;

said first and second channel-shaped members are provided with complimentary channel-shaped ends jointly constituting a said end of a magazine for reception of said channel-shaped ends jointly in said cavity of the firearm in lieu of said standard magazine; and said cartridge seater is biased toward said channel-shaped ends.

20. Apparatus for storing cartridges for a firearm with each cartridge including a hollow-cylindrical shell carrying a bullet at a first end thereof and having a circular bottom at an opposite second end thereof, comprising in combination:

a channel-shaped container having a bottom wall of a width larger than the diameter of said circular bottom, but smaller than twice said diameter and side walls corresponding in height to a height of said shell, and having an elongate open top extending between side walls opposite and parallel to said closed bottom wall and corresponding in width to said bottom wall, for receiving said cartridges into said container so that the circular bottom of each cartridge is located at said closed bottom wall, so that the shell of each cartridge extends parallel to and is retained between said side walls and so that the bullets of said cartridges are located at said open top;

a cartridge seater in said channel-shaped container having a projecting handle, one of said side walls having an elongate slot for projection of said handle out of said one side wall of the container and movement of said handle and cartridge seater along said container; and a lid for closure of said open top above said bullets as seen from the circular bottoms of said placed cartridges for retention of cartridges in said channel-shaped container preparatory to a transfer of said retained cartridges through an opening out of said channel-shaped container.

21. Apparatus as claimed in claim 20, including:

means for hinging said lid on said channel-shaped container at the end of said channel-shaped container opposite said opening.

22. Apparatus as claimed in claim 20, wherein:

said lid has a channel-shaped configuration having a lid top spaced from and extending parallel to said bottom wall and having lid side walls extending from said lid top to the container side walls when said lid is located on said channel-shaped container for closure of said open top.

23. Apparatus as claimed in claim 22, including:

means for hinging said lid having said channel-shaped configuration on said channel-shaped container at an end of said channel-shaped container opposite said opening.

24. Apparatus as claimed in claim 20, including:

means including at least one of said side walls for guiding said cartridge seater during movement of said handle and cartridge seater along said container.

25. Apparatus as claimed in claim 20, including:

means including the other of said side walls as a guide for said cartridge seater during movement of said handle and cartridge seater along said container.

26. Apparatus as claimed in claim 20, including:

roller means on said cartridge seater rollable along an internal surface of at least one of said side walls during transfer of said received cartridges through said opening.

27. Apparatus as claimed in claim 20, including:

a retainer encompassing said opening for retaining said channel-shaped container on a magazine during transfer of said placed cartridges into said magazine of the firearm.

28. Apparatus as claimed in claim 20, wherein:

said firearm has a cavity for receiving an end of a magazine being standard for that firearm;

at least said channel-shaped container has a said end for reception in said cavity of the firearm in lieu of said standard magazine; and said apparatus includes means for biasing said cartridge seater toward said end of said channel-shaped container.

29. Apparatus as claimed in claim 20, wherein:

said firearm has a cavity for receiving an end of a magazine being standard for that firearm;

said channel-shaped container and said lid have complementary channel-shaped ends jointly constituting a said end of a magazine for reception of said channel-shaped ends jointly in said cavity of the firearm in lieu of said standard magazine; and said apparatus includes means for biasing said cartridge seater toward said channel-shaped ends.

30. Apparatus for storing cartridges for a firearm with each cartridge including a hollow-cylindrical shell carrying a bullet at a first end thereof and having a circular bottom at an opposite second end thereof, comprising in combination:

a first channel-shaped member having a width of more than one and less than two diameters of said circular bottom;

a second channel-shaped member extending along said first channel-shaped member;

a composite first wall for said first and second channel-shaped members having a first wall portion integral with and extending along said first channel-shaped member and having a second wall portion integral with an extending along said second channel-shaped member;

a composite second wall having a third wall portion integral with and extending along said first channel-shaped member and having a fourth wall portion integral with and extending along said second channel-shaped member;

said first wall portion having an elongate slot along at least part thereof;

a cartridge setter in said first channel-shaped member having a handle extending through said slot;

an exposable top of said first channel-shaped member between said first and second channel-shaped members for receiving each cartridge at the shell and circular bottom of the cartridge through said top upon exposure of said top; and a joint opening of said first and second channel-shaped members for a transfer of said received cartridges out of said channel-shaped members upon movement of said cartridge seater toward said joint opening.

31. Apparatus as claimed in claim 30, wherein:

said first and third wall protions are flush with each other; and said second and fourth wall portions are flush with each other.

32. Apparatus as claimed in claim 30, including:

means for hinging said second channel-shaped member on said first channel-shaped member opposite said joint opening.

33. Apparatus as claimed in claim 30, including:

means including at least one of said wall portions for guiding said cartridge seater during movement of said handle and cartridge seater along said elongate slot.

34. Apparatus as claimed in claim 30, including:

a retainer encompassing said joint opening for retaining said channel-shaped members on the magazine.

35. Apparatus as claimed in claim 30, wherein:

said firearm has a cavity for receiving an end of a magazine being standard for that firearm;

at least one of said channel-shaped members has a said end for reception in said cavity of the firearm in lieu of said standard magazine; and said apparatus includes means for biasing said cartridge seater toward said end of said at least one channel-shaped member.

36. Apparatus as claimed in claim 30, wherein:

said firearm has a cavity for receiving an end of a magazine being standard for that firearm;

said first and second channel-shaped members have complementary channel-shaped ends jointly constituting a said end of a magazine for reception of said channel-shaped ends jointly in said cavity of the firearm in lieu of said standard magazine; and said apparatus includes means for biasing said cartridge seater toward said channel-shaped ends.

* * * * *